US010215543B1

(12) United States Patent
Benson

(10) Patent No.: US 10,215,543 B1
(45) Date of Patent: Feb. 26, 2019

(54) LINEAR EXPLOSIVE DISRUPTOR

(71) Applicant: Mark Benson, San Diego, CA (US)

(72) Inventor: Mark Benson, San Diego, CA (US)

( * ) Notice: Subject to any disclaimer, the term of this patent is extended or adjusted under 35 U.S.C. 154(b) by 754 days.

(21) Appl. No.: 13/891,125

(22) Filed: May 9, 2013

Related U.S. Application Data

(60) Provisional application No. 61/645,173, filed on May 10, 2012.

(51) Int. Cl.
*F42B 3/08* (2006.01)

(52) U.S. Cl.
CPC ..... *F42B 3/08* (2013.01)

(58) Field of Classification Search
CPC ..... F42B 3/08
USPC ..... 86/50; 89/1.13
See application file for complete search history.

(56) References Cited

U.S. PATENT DOCUMENTS 1,429,619 A * 9/1922 Nelson ..... F41A 21/36 89/14.3
1,770,471 A * 7/1930 Hatcher ..... F41A 21/30 181/223
3,045,623 A * 7/1962 Tylcr ..... B63C 7/04 114/333
3,048,104 A * 8/1962 Riggs ..... F42B 8/04 102/530
3,157,124 A * 11/1964 Muller ..... F42B 12/12 102/476
3,186,304 A * 6/1965 Biehl ..... F41F 1/00 102/306
3,188,955 A * 6/1965 Brown ..... F42B 1/02 102/306
3,658,006 A * 4/1972 Nistler ..... F42B 3/08 102/307
3,677,132 A * 7/1972 Plenge ..... F41A 21/30 42/1.14
3,707,899 A * 1/1973 Perrine ..... F41A 21/36 89/14.3
3,744,427 A * 7/1973 Good ..... F02K 9/72 102/285
3,748,956 A * 7/1973 Hubner ..... F41A 21/30 89/14.4
3,763,740 A * 10/1973 Fletcher ..... F41F 1/00 102/532
4,055,247 A * 10/1977 Benedick ..... F42B 39/14 206/3

(Continued)

*Primary Examiner* — Joshua E Freeman
*Assistant Examiner* — Bridget A Cochran
(74) *Attorney, Agent, or Firm* — Gorman IP Law, APC

(57) ABSTRACT

A lightweight linear explosive disruption tool that may be used to fire a high speed projectile at a hazardous device in order to separate the components of the explosive train, thereby rendering it safe. The linear explosive disruption tool utilizes open cellular foam materials to prevent collateral damage of explosive gases and fragmentation that would otherwise prevent the device from being fired from a robot. An internal clapper tube distributes forces to the ligaments of cellular foam material and an external support tube contains the explosive fragmentation and blast overpressure. An internal barrel provides projectile travel in a single precision oriented direction and also reduces recoil which also enables the device to be fired from a robot as well. Such a tool prevents explosive gases and fragmentation from causing unnecessary collateral damage to the surroundings or supporting robot with reduced recoil effects.

15 Claims, 3 Drawing Sheets

(56) References Cited

U.S. PATENT DOCUMENTS 4,126,078 A * 11/1978 Ashley ..... F41A 1/04 102/440
4,132,149 A * 1/1979 Ashley ..... F42B 5/16 89/1.704
4,160,413 A * 7/1979 Ridgeway ..... F42B 3/08 102/306
4,187,782 A * 2/1980 Grace ..... F42B 1/02 102/475
4,239,006 A * 12/1980 Kelson ..... F42B 14/064 102/511
4,530,417 A * 7/1985 Daniel ..... F41A 21/30 181/223
4,621,562 A * 11/1986 Carr ..... B25J 5/007 180/22
4,652,204 A * 3/1987 Arnett ..... B25J 5/007 212/901
4,753,473 A * 6/1988 Arnett ..... B25J 15/0206 294/104
4,957,027 A * 9/1990 Cherry ..... F42B 33/062 86/50
5,194,690 A * 3/1993 Guthrie ..... F41A 1/00 102/307
5,303,633 A * 4/1994 Guthrie ..... F42B 5/16 102/440
5,385,101 A * 1/1995 Corzine ..... F42B 12/34 102/509
5,400,716 A * 3/1995 Mayer ..... F42B 12/78 102/507
5,493,973 A * 2/1996 Brion ..... F42B 5/192 102/431
5,515,767 A * 5/1996 Gilbert ..... F41A 1/10 86/50
5,746,018 A * 5/1998 Kirschner ..... F41A 21/32 42/1.14
5,936,184 A * 8/1999 Majerus ..... F42B 3/08 102/306
5,947,051 A * 9/1999 Geiger ..... B62D 57/00 114/222
6,113,343 A * 9/2000 Goldenberg ..... B25J 5/005 239/587.2
6,176,186 B1 * 1/2001 Engel ..... F42B 12/34 102/506
6,196,107 B1 * 3/2001 Hoffman ..... F42B 39/14 206/3
6,269,725 B1 * 8/2001 Cherry ..... F42B 1/02 102/306
6,298,764 B1 * 10/2001 Sherman ..... F41A 21/34 89/14.2
6,363,828 B1 * 4/2002 Sherlock ..... F42B 3/00 102/202.14
6,408,731 B1 * 6/2002 Elsener ..... F41A 1/10 102/440
6,439,127 B1 * 8/2002 Cherry ..... F42B 12/36 102/402
6,490,957 B1 * 12/2002 Alexander ..... F41B 11/00 102/230
6,581,521 B1 * 6/2003 Dixon ..... F42B 12/46 102/334
6,625,083 B2 * 9/2003 Vandenbroucke ... G01V 1/3852 181/112
6,805,057 B2 * 10/2004 Carr ..... F42B 12/34 102/507
6,979,758 B2 * 12/2005 Eidelman ..... C06B 21/0091 102/402
7,281,309 B2 * 10/2007 Reynolds ..... B65F 1/02 220/62.15
7,299,735 B2 * 11/2007 Alford ..... F42B 33/062 86/43
7,503,260 B2 * 3/2009 Kapeles ..... F42B 5/02 102/439
7,814,821 B2 * 10/2010 Chenel ..... A45F 5/00 102/305
7,836,811 B1 * 11/2010 Gardner ..... F41A 23/28 102/402
7,878,105 B2 * 2/2011 More ..... F41A 25/04 89/43.01
8,006,621 B1 * 8/2011 Cherry ..... B26F 3/04 102/307
8,037,828 B1 * 10/2011 Jakaboski ..... F42B 1/02 102/305
8,171,852 B1 * 5/2012 Rebar ..... F42B 12/34 102/509
8,201,486 B1 * 6/2012 Fuhrman ..... F41A 1/04 89/7
8,276,495 B1 * 10/2012 Chiu ..... F41A 21/485 42/1.08
8,438,767 B2 * 5/2013 Rebar ..... F42B 12/34 102/509
8,677,902 B1 * 3/2014 Rock ..... F42B 1/028 102/306
8,887,609 B1 * 11/2014 Cherry ..... F42B 33/06 86/50
9,003,974 B2 * 4/2015 Muskat ..... F42B 12/02 102/507
9,470,484 B2 * 10/2016 Benson ..... F42B 39/002
2003/0070540 A1 * 4/2003 Zavitsanos ..... C06B 33/00 86/50
2004/0079221 A1 * 4/2004 Woods ..... F41A 21/34 89/14.4
2005/0081706 A1 * 4/2005 Alford ..... F42B 33/062 89/1.13
2005/0252915 A1 * 11/2005 Schmidt ..... B65F 1/02 220/88.1
2005/0288819 A1 * 12/2005 de Guzman ..... F16L 55/32 700/245
2006/0011056 A1 * 1/2006 Edwards ..... F41A 25/02 89/14.3
2007/0039453 A1 * 2/2007 Toycen ..... F42D 5/045 86/50
2007/0209500 A1 * 9/2007 Wilber ..... F42D 5/045 86/50
2008/0011152 A1 * 1/2008 Weiss ..... F41A 19/58 86/50
2008/0121097 A1 * 5/2008 Rudakevych ..... F41A 19/58 89/28.05
2008/0216700 A1 * 9/2008 Martini Filho ..... F42B 12/34 102/509
2009/0116946 A1 * 5/2009 Chenel ..... B25J 18/025 414/679
2009/0178548 A1 * 7/2009 Tyas ..... F41B 9/0046 86/50
2009/0252558 A1 * 10/2009 Masters ..... B63C 11/52 405/195.1
2009/0294218 A1 * 12/2009 Archer ..... B66F 9/065 187/237
2009/0294584 A1 * 12/2009 Lovell ..... B63B 27/10 244/110 F
2010/0224054 A1 * 9/2010 Langner ..... F41A 21/36 89/14.3
2010/0269964 A1 * 10/2010 Zubrin ..... C06B 47/04 149/1
2012/0097015 A1 * 4/2012 Alford ..... F41B 9/0046 86/50
2014/0224101 A1 * 8/2014 Benson ..... F42B 1/02 86/50
2014/0352568 A1 * 12/2014 Benson ..... F42B 39/002 102/331
2015/0040745 A1 * 2/2015 Joseph ..... F42B 10/40 86/50

* cited by examiner

LINEAR EXPLOSIVE DISRUPTOR

CROSS-REFERENCE TO RELATED APPLICATIONS

This Nonprovisional application claims priority under 35 U.S.C. § 119(e) on U.S. Provisional Application No. 61/645,173 filed on May 10, 2012, the entire contents of which are hereby incorporated by reference in its entirety.

TECHNICAL FIELD

Embodiments of the present invention relate to the technical field of explosives. More particularly, the embodiments of the present invention are directed to disruption and rendering safe of explosive hazardous devices.

BACKGROUND OF THE INVENTION

Explosive hazardous devices include improvised explosive devices, unexploded ordnance, homemade explosives, or other explosive related items which are located either underwater or on land. These devices pose a threat to personnel and property due to the destructive potential of the explosive materials and compounds located within them.

Personnel who are responsible for disarming or rendering safe explosive hazardous devices utilize explosive disruption devices or special tools in order to carry out these types of operations. Some of these devices or tools include explosive disruption tools that utilize water, or similar fluids, to disrupt and preserve the explosive train as evidence for forensic purposes. Many times, the success of a successful "render safe" operation depends on the speed at which the components of the explosive train are separated. Explosive disruption tools are advantageous for these types of operations because the energy of an explosive detonation leads to high kinetic energies that propel water, for example, toward the targeted device (see U.S. Pat. No. 6,269,725). These velocities can range anywhere from 1500 feet/sec to 6000 ft/sec, depending on the explosive disruption tool chosen, and often lack precision disruption capabilities.

Other explosive tools may utilize a number of projectiles such as shape charges, platter charges, explosively formed penetrators, or other common methodologies to disrupt hazardous devices (see patent U.S. Ser. No. 10/500,880). While these tools may utilize water for disruption purposes, the additional benefits of firing a projectile towards an individual component or "burning through" explosive compounds adds versatility to enable the operator to respond accordingly to the hazardous device. Explosively formed penetrators, platter charges, shape charges, multiple pellets ("buckshot"), or cylindrical wedges like those fired from the MK 2 Dearmer are all tools that must be available to operational response personnel.

While explosive tools have high velocities and kinetic energies, they cause considerable amounts of collateral damage when fired. The detonation that takes place to excel the projectile or water makes the tool unbeneficial for situations where collateral damage must be minimized. Examples include situations where a tool must be fired from a robot or when forensic evidence must be preserved.

In order to target individual components or to reduce collateral damage, operators may utilize shotgun type tools that are filled with either water, clay, or metal projectiles in order to conduct render safe operations. While these tools are effective, the projectile velocities are typically low in comparison to explosive disruption charges (less than 2,000 feet/sec). In addition, the length, size, weight, and inability to reduce the recoil effects of these disruption tools makes them non-ideal for robot operations.

BRIEF SUMMARY OF THE INVENTION

Therefore, there is a need to manufacture a linear explosive disruption tool that uses a number of different projectiles in order to render safe a hazardous device. Such a linear explosive disruption tool must be lightweight, compact, easy to use, and be able to be fired from a robot in both an underwater and terrestrial environment without damaging the robot.

It is the objective of the present invention to provide a protective chamber around a barrel that prevents explosive gases and fragmentation that would otherwise cause collateral damage from penetrating the chamber.

It is a further objective of the present invention to explosively propel a variety of projectiles through the barrel for precision targeting. These projectiles include explosively formed penetrators, water, pellets, and other shape charges common to explosive ordnance disposal operations.

It is a still further objective of the present invention to allow for firing with limited recoil from a robot or firing stand. Typically, the robot or firing stand is not significantly damaged by the limited recoil of the present invention. "Limited recoil" refers to no discernible recoil or to a reduction in recoil of at least 5%, 10%, 20%, 30% or more, such as 40%, 50% 60%, 70%, 80%, 90% or 95%. The gases escaping rearward from the present invention reduces the recoil effect common to gun type disruption tools.

It is yet a further objective of the present invention to provide a system that utilizes foam based materials containing air pockets, or honeycombs, to disperse the explosive gases such that the container does not rupture. These same foam materials are also able to absorb energy (vice absorb shock) through the buckling or collapsing of the ligament structure. The energy absorbed is the result of material failure; the specific properties of the foam materials are depicted by its unique stress strain curve and are used to select appropriate foams. Unlike a shock absorber on a car which redirects and dampens the impulse force that results from the car hitting a speed bump in the road and maintains the car's stature, the foam materials used in the instant invention would absorb the impulse force by buckling the foam ligament structures, resulting in the car being lower to the ground. This buckling ability of foam materials, and the combination of diffusion of explosive gases, makes ligament structures that are present in foams ideal for explosive related energy absorption applications.

In the case of the present invention, the combination of foam materials, clapper plates, and clapper disks, which apply the loading to the ligament structure, enable the device to withstand powerful explosive events. While increasing the thickness of a pressure vessel wall may withstand similar blast pressures, this adds significant weight to the device. The combination of foam and clapper plates of the present invention reduces the overall weight of the device and ensures that the device is suitable for tactical operations, where weight decreases the effectiveness of the warfighter.

It is still another objective of the present invention to be used on underwater or terrestrial robots, as well as being fired from a number of other platforms. As an example, the linear explosive disruptor may be positioned on a camera stand, a suction cup, or a clamp device, in addition to positioning on a robot, making the positioning highly versatile for the operator.

BRIEF DESCRIPTION OF THE DRAWINGS

The present invention will become more fully understood from the detailed description given herein below and the accompanying drawings which are given by way of illustration only, and thus are not limitative of the present invention, and wherein.

DETAILED DESCRIPTION OF THE ILLUSTRATED EMBODIMENTS

Figure 1:
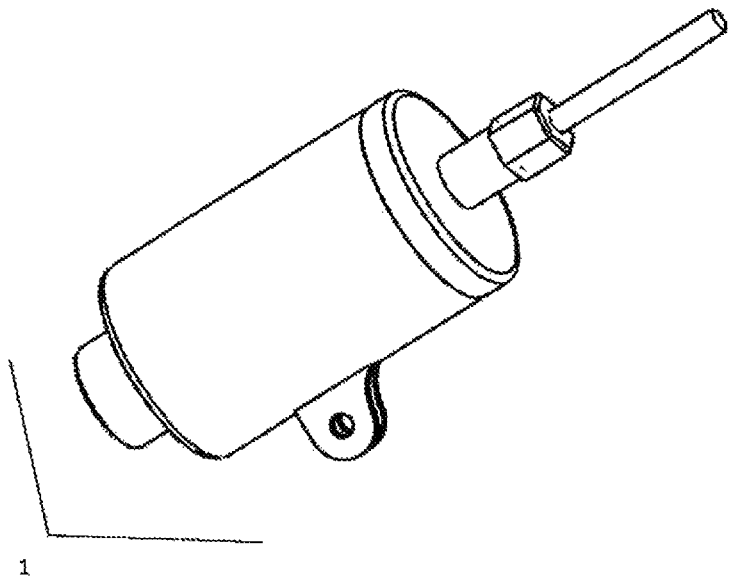
FIG. 1 is a perspective view of the linear explosive disruption tool 1 configured for firing, but prior to being placed on a robot or firing stand in accordance with one embodiment of the present invention.

The present invention will now be described in detail with reference to the accompanying drawings, wherein the same reference numerals will be used to identify the same or similar elements throughout the several views. It should be noted that the drawings should be viewed in the direction of orientation of the reference numerals.

FIG. 1 illustrates a linear explosive disruption tool 1 that is configured for use against an underwater or terrestrial hazardous explosive device. The linear explosive disruption tool 1 may be integrated onto a robotic platform or may also be fired from a stand or other attachment device. An alignment or method of aiming the device is not included, but one of skill in the art may easily see that a number of standard methodologies may be employed to do so, such as a laser boresight, a mechanical alignment sight, or any type of fixed sight common to other firearms.

Figure 2:
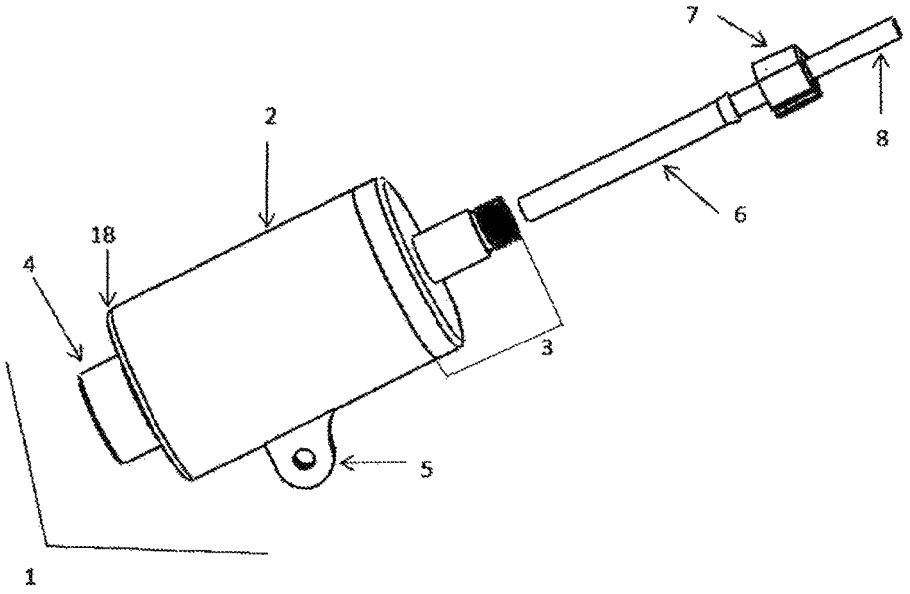
FIG. 2 is a perspective view of the linear explosive disruption tool 1 shown with the blasting cap 6 removed in accordance with one embodiment of the present invention.

FIG. 2 is an illustration of the linear explosive disruption tool 1 with the blasting cap 6 and initiator system 8 removed from the linear explosive disruption tool 1. FIG. 2 illustrates the exterior housing 2, exterior rear housing 3, end cap 4, mount 5, blasting cap 6, hex cap 7, and initiation system 8.

FIG. 2 shows the exterior housing 2 and exterior rear housing 3 in accordance with one embodiment of the present invention. The exterior housing 2 and exterior rear housing 3 are constructed of lightweight materials that are strong in molecular makeup. Examples of these materials include plastics such as polycarbonates, composite materials, or metallic materials or other similar materials that enable the linear explosive disruption tool 1 to be used for maritime operations where the pressure due to subsurface depth may otherwise rupture a weak structure. The purpose of the exterior housing 2 and exterior rear housing 3 is to secure the internal components into proper position within the exterior housing 2 and exterior rear housing 3 once the device is fully assembled and to provide a structural support for the end cap 4, mount 5, and hex cap 7. In addition, an optional sight mount may be added to either the exterior housing 2, exterior rear housing 3, or both in order to integrate a laser aiming sight, or similar device, for targeting.

The exterior housing 2 is a cylindrical hollow body consisting of an inner and outer wall and defines the outer limit of the chamber tube 9. On one end of the exterior housing 2 is a cover cap 18. The cover cap 18 can be separate from the exterior housing 2 or can be an inseparable extension of the exterior housing 2. When the cover cap 18 is separate from the exterior housing 2, it can be attached to the exterior housing 2 by a threaded fastener, a snapping fastener, detent, glue, a weld or any other means of fastening known by one of skill in the art to be useful. The cover cap 18 has a circular opening and comprises an external cylindrical hollow body extrusion on one face of the cover cap 18. The extrusion comprises an inner and outer walled tube that is exteriorly threaded, or snaps, in order to fasten to the end cap 4. That is, the end cap 4 can be attached to the cover cap 18 using any type of fastener or detent. The end cap 4 is used to secure the projectile housing 14 in the correct position prior to firing. Both the cover cap 18 and the end cap 4 can be made of the same materials as the exterior housing 2 In addition, the exterior housing 2 has two parallel extrusions on the exterior surface of the outer wall. These extrusions comprise the mount 5, which is used to attach the linear explosive disruption tool 1 to a robot, firing stand, or other attachment device. One of skill in the art recognizes that the mount 5 may be modified or optimized for the intended use.

The exterior rear housing 3 attaches to the exterior housing 2 in order to contain the internal contents of the linear explosive disruption tool 1. Like the cover cap 18 that reduces the opening of the exterior housing 2, the exterior rear housing 3 also comprises a cover cap with an opening that is linked to a cylindrical hollow body extruding from the cover cap. The cylindrical extrusion has an inner wall and an outer wall and supports the placement of a blasting cap 6 and initiation system 8. At the end of the extrusion is a connection point for the hex cap 7. The hex cap 7 is used to secure the initiation system 8 and blasting cap 6 into position within the linear explosive disruption tool 1. The exterior rear housing 3 can be made of the same materials as the exterior housing 2. Like the cover cap 18, the exterior rear housing 3 can be separate from the exterior housing 2 or can be an inseparable extension of the exterior housing 2. When the exterior rear housing 3 is separate from the exterior housing 2, it can be attached to the exterior housing 2 by a threaded fastener, a snapping fastener, detent, glue, a weld or any other means of fastening known by one of skill in the art to be useful.

Figure 3:
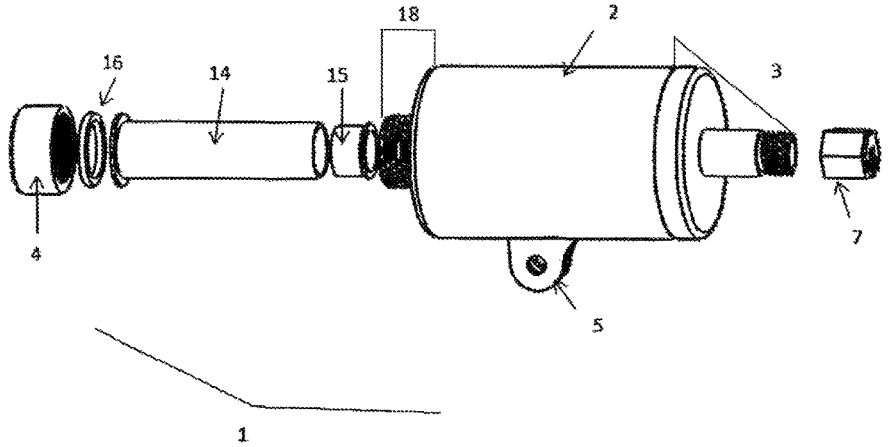
FIG. 3 is a perspective view of the linear explosive disruption tool 1 prior to assembly of the projectile in accordance with another embodiment of the present invention.

FIG. 3 shows an external view of the linear explosive disruption tool 1 with the components disassembled. In addition to the exterior housing 2, exterior rear housing 3, mount 5, cover cap 18, end cap 4, and hex cap 7 shown in FIG. 2, FIG. 3 also shows the projectile housing 14, explosive cavity lid 15, and o-ring 16.

The projectile housing 14 shown in FIG. 3 is one configuration of the present invention. The projectile housing 14 is a tubular extrusion with inner and outer walls. One end of the projectile housing 14 is closed. The closed end of the projectile housing 14 has a larger diameter than the outer wall of the tubular extrusion that is created by a flange or flange-type extrusion. This allows the projectile housing 14 to seat into place on the circular hollow body extrusion of the cover cap 18 attached to the exterior housing 2 and to be secured in place with an O-ring 16 when the end cap 4 is secured into position. The projectile housing 14 may be filled or loaded with water, pellets, a solid projectile, shape charge, platter charge, combinations thereof or any number of other variants that can serve as projectiles. In order to hold the projectile(s) within the projectile housing 14, an explosive cavity lid 15 is inserted into the open end of the projectile housing 14. The explosive cavity lid 15 comprises a cylindrical hollow body, closed at one end and having a smaller diameter than the projectile housing 14, such that it fits tightly inside the projectile housing, containing the desired projectile material within the projectile housing 14. The open end of the explosive cavity lid 15, is flanged such that the diameter of its outer edges is identical to the diameter of the projectile housing 14. The explosive cavity lid 15 not only maintains the projectile within the projectile housing 14, but also holds the explosive compound that is packed into its internal cavity by the operator. The projectile housing 14 is snapped into place, creating a watertight fitting as required. Both the projectile housing 14 and the explosive cavity lid 15 can be made from plastics, composites, or other lightweight structural materials.

Figure 4:
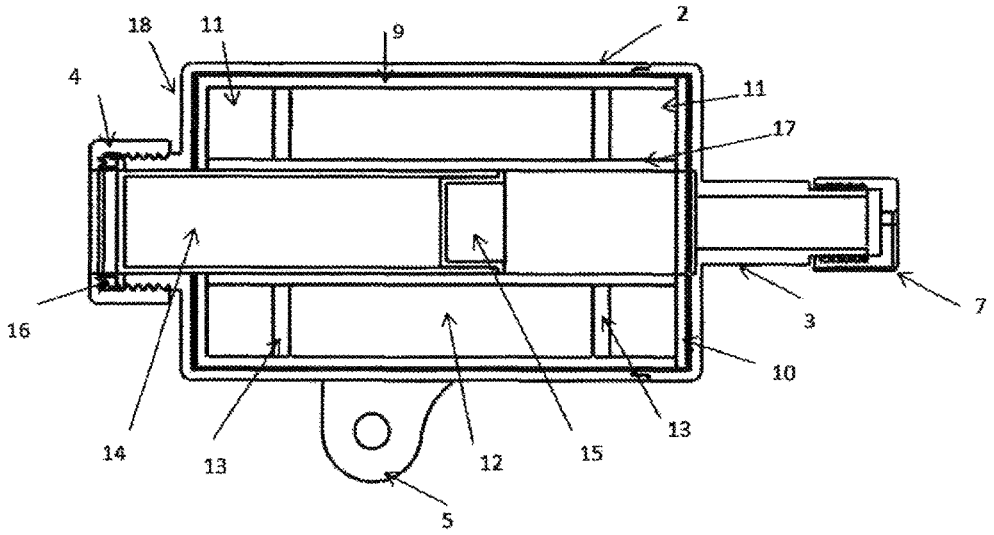
FIG. 4 is a cross-sectional view of the linear explosive disruption tool 1 in accordance with one embodiment of the present invention.

FIG. 4 is a cross sectional view of the linear explosive disruption tool 1. Introduced in FIG. 4 and located within the exterior housing 2 and exterior rear housing 3 are the chamber tube 9, chamber tube end piece 10, foam disk 11, foam tube 12, clapper disk 13, projectile housing 14, and the explosive cavity lid 15, and barrel 17.

In order to confine explosive gases and fragmentation within the linear explosive disruption tool 1, open celled materials such as high strength polyethylene, metal, or carbon composites are used in conjunction with other high strength materials to support the positioning of the open celled materials. The open celled materials are shown in FIG. 4 as the foam disks 11 and foam tube 12. The unique characteristics of these materials enable the linear explosive disruption tool 1 to be lightweight, and the open celled materials not only absorb fragmentation, but also diffuse explosive gases upon the detonation of the explosive compound. In addition, the open celled materials serve as a flame arrestor. In other words, some of the fire that may be sent through a solid barrel is actually absorbed into the foam materials upon failure of the barrel 17. Reducing the fire and heat is beneficial in that it reduces the chance of forensic evidence degradation. As a comparison, a gun that fires a shotgun round with water is accompanied by a relatively large fire ball because the energy has one direction to travel, out the end of the barrel and toward the forensic evidence.

In addition, the open celled materials serve as energy absorbing materials. The foam disks 11 and foam tube 12 structurally support the barrel 17, but also support the controlled failure of the barrel 17. That is, when failure of the barrel 17 occurs, the foam disks 11 and foam tube 12 catch the fragmentation and slow down an otherwise violent event.

The foam disks 11 and foam tube 12 are located within and concentric to the chamber tube 9, which is contained within the area defined by the housing 2, cover cap 18 and exterior rear housing 3 of the linear explosive disruption tool 1. The foam disks 11 and foam tube 12 have an inner diameter that is slightly larger than the barrel 17 and an outer diameter that is slightly smaller than the interior diameter of the chamber tube 9. This allows the foam disks 11 and foam tube 12 to be assembled around the barrel 17 and within the chamber tube 9. In some embodiments the foam disks 11 have a slightly lower porosity and density than the foam tube 12. This reduces weight at a point further from the point of detonation and also enables gases to travel away from the closest wall of the chamber tube 9.

The chamber tube 9 and chamber tube end piece 10 are formed from materials such as titanium, stainless steel, carbon composites, or other substances that may be used in order to contain the explosive gases and fragmentation associated with the intended detonation. The chamber tube 9 is a hollow cylindrical body with an inner and outer wall concentric with the housing 2. On one end of the chamber tube 9 is an end cap. The end cap has a circular extrusion located concentrically on the face. This diameter is equal to or greater than the projectile housing 14 so that the projectile housing 14 may be inserted into the barrel 17 which is located within and concentric to the chamber tube 9. For manufacturing purposes, the chamber tube 9 has a chamber tube end piece 10. The chamber tube end piece 10 has the same dimensions of the chamber tube 9 end cap and mirrors the circular extrusion diameter.

Located within and concentric to the chamber tube 9 is the barrel 17. The barrel 17 provides linear support to the explosive gases in order to allow the gases to travel along a single axis. The barrel 17 is manufactured of titanium, stainless steel, carbon composites, or other substitute materials that may be used in conjunction with the open celled materials to explosively fire the projectile. The barrel 17 is a tube consisting of an inner and outer wall. The inner diameter of the barrel 17 is slightly larger than the projectile housing 14. This enables the projectile housing 14 and explosive cavity lid 15 to be inserted within the barrel 17.

FIG. 4 also illustrates two clapper disks 13. The clapper disks 13 are used in order to uniformly collapse the open celled materials of the foam disks 11 and foam tube 12. In other words, the clapper disks 13 push on the ligament structures of the open celled materials and cause the open celled materials to buckle uniformly. Both clapper disks 13 have at least one flat surface with outer and inner diameters. The outer diameter of the clapper disks 13 is slightly less than the inner diameter of the chamber tube 9 and the inner diameter is slightly larger than the outer diameter of the barrel 17. In addition, the clapper disks 13 structurally support the barrel 17 and hold it in place. For these reasons, the clapper disks 13 are preferably created from a similar material as the barrel 17.

While the foregoing written description of the invention enables one of ordinary skill to make and use the invention, those of ordinary skill will understand and appreciate the existence of variations, combinations, and equivalents of the specific embodiment, method, and examples herein. The invention should therefore not be limited by the above described embodiment, method, and examples, but by all embodiments and methods within the scope and spirit of the invention.

Operation of Device

The configuration of the illustrated embodiment of the linear explosive disruption tool 1 is intended to fire a projectile in the form of water, shape charge, pellets, explosively formed penetrator, platter charge, combinations thereof or other form of projectile in order to defeat a hazardous explosive device. The current configuration reduces the collateral damage associated with the detonation of an explosive tool and reduces the recoil in order to enable the linear explosive disruption tool 1 to be fired from a robotic platform without damaging the robot. The capabilities afforded this tool increase safety and protection for personnel responsible for conducting render safe operations.

In order to utilize the linear explosive disruption tool 1, the operator must first determine the proper mounting platform to which the linear explosive disruption tool 1 will fix for the applicable scenario. For increased operational versatility, the linear explosive disruption tool 1 may utilize a variety of clamps, suction cups, camera stands, and other items that integrate to the mount 5 located on the exterior housing 2 of the linear explosive disruption tool 1. One such configuration may be on the arm of a robot. A second configuration for dismounted operations may utilize an adjustable camera stand.

Once the linear disruption tool 1 is mounted to the desired platform from which to be fired, the operator may select the projectile required for the specific hazardous explosive device encountered. As an example, water may be used as a general disruption projectile when shot from a robot in cases where the hazardous explosive device is a soft cased bag. Alternatively, an explosively formed penetrator may be used for a hardened target such as a underwater mine casing. The variety of shape charges, liquid mediums, or projectiles that may be used increases the ability of the operator to determine the best course of action for each hazardous explosive device encountered. Each of these projectiles is housed within the projectile housing 14. While modifications to the projectile housing 14 occur for each projectile chosen, it may be recognized that the projectile fired is merely a function of operator choice and the modified configuration of the projectile housing 14, as described below. The low collateral and reduced recoil system associated with the design of the linear disruption tool 1 is, for the most part, uninhibited by the selection of the projectile fired.

One option is to utilize a liquid within the projectile housing 14. The operator would fill the projectile housing 14 with liquid and insert the explosive cavity lid 15 into position to create a watertight fit. The operator may then insert explosives into the explosive cavity lid 15. For low velocity operations, such as a small envelope, the operator may choose to utilize a blasting cap 6 without additional explosive compounds.

Other options may be to utilize a solid projectile or even a shape charge. The projectile housing 14 may be slightly modified in order to accommodate each. These modifications may include the explosive cavity lid 15. Or, as in the event of an explosively formed penetrator, may be packed by hand and inserted into the projectile housing 14 without the use of the explosive cavity lid 15.

Once the operator has filled the projectile housing 14 and attached the explosive cavity lid 15, if one is being used, he may insert the projectile housing 14 and optional explosive cavity lid 15 into the barrel 17 of the linear explosive disruption tool 1. The projectile housing 14 is slid into the barrel 17 until the extrusion of the projectile housing 14 connects with cover cap 18 of the linear exterior housing 2 of the linear explosive disruption tool 1. Once in position, the operator ensures the O-ring 16 is in place and fastens the end cap 4 to the threads located on the cylindrical extrusion of the cover cap 18 of the exterior housing 2 until secured into position. The addition of the O-ring 16 enables the tool to remain watertight for underwater operations.

After loading the barrel 17 with the projectile housing 14, the operator may then "prime into" the tool. A blasting cap 6 with an attached initiation system 8 is a common initiator used for explosively related operations. Once the blasting cap 6 is inserted through the cylindrical hollow body extrusion of the exterior rear housing 3 into the barrel 17 located in chamber tube 9 and seated into the explosive cavity lid 15, the hex cap 7 is fastened and secured into place around the threaded cylindrical hollow body extrusion located on the exterior rear housing 3. The tightening of the hex cap 7 also creates a watertight boundary to support maritime related operations. Alternatively, the cylindrical body can be configured to snap the hex cap 7. In addition, the blasting cap 6 may be modified from the current drawing. The example shown is for a common, military-type of blasting cap 6. A number of other detonators, initiators, or blasting caps exist and can be used. In some cases, a "slap det" may also be utilized as a substitute for the blasting cap 6 shown.

The linear explosive disruption tool 1 is now ready to be utilized as required. The operator may choose to fire the linear explosive disruption tool 1 from a robot. In this case, an optional laser sight or similar targeting aid may be mounted to the exterior housing 2. The low collateral design of the linear explosive disruption tool 1 prevents the targeting device from being damaged; thereby ensuring that it may be utilized for continual operations.

What is claimed is:

1. A linear explosive disruption tool, comprising: an exterior housing; a cover cap; a first interior chamber fully contained within the exterior housing; a barrel, wherein the barrel provides linear support to explosive gases allowing the gases to travel rearward along a single axis and exit the linear explosive disruption tool; a second interior chamber being concentrically connected and completely internal to a cavity formed by the barrel and the cover cap; a projectile housing comprising a projectile and explosive cavity lid concentrically connected to the projectile housing at one end; a blasting cap or explosive, wherein upon detonation explosively propels the projectile through the barrel to exit the entire linear explosive disruption tool for precision targeting; a third interior chamber fully contained within the projectile housing and within the second interior chamber; at least one high strength foam metal absorber placed within the first interior chamber of the exterior housing and having the ability to collapse due to absorption of fragmentation and absorption of energy generated from the barrel during an explosion of a blasting cap or explosive in the barrel; and at least one clapper member disposed within the first interior chamber of the housing, wherein the clapper member is surrounded by the high strength foam metal absorber and mechanically transfers fragmentation, gases and energy generated from the barrel during the explosion of the blasting cap or explosive in the barrel.

2. The linear explosive disruption tool of claim 1, further comprising a mount located on the exterior of the housing.

3. The linear explosive disruption tool of claim 1, further comprising an end cap.

4. The linear explosive disruption tool of claim 1, wherein the rearward escape of gases after explosion of the blasting cap or explosive in the barrel reduces recoil.

5. A method of operating the linear explosive disruption tool of claim 1, comprising the steps of:

placing at least one projectile within the projectile housing;

placing the projectile housing within the second interior chamber of the linear explosive disruption tool;

placing a blasting cap or explosive into the barrel of the linear explosive disruption tool;

targeting the linear explosive disruption tool; and detonating the blasting cap or explosive causing the projectile to be explosively propelled through the barrel and exiting the linear explosive disruption tool for precision targeting, wherein the step of inserting the blasting cap or explosive results in aligning the blasting cap or explosive with the projectile housing.

6. The method of claim 5, further comprising mounting the linear explosive disruption tool on a robot.

7. The method according to claim 6, wherein said robot is an underwater robot.

8. The method according to claim 6, wherein said robot is terrestrial.

9. The linear explosive disruption tool according to claim 1, wherein the projectile is selected from the group consisting of water, an explosive shape charge, pellets, explosively formed penetrator, platter charge, and combinations thereof.

10. The linear explosive disruption tool of claim 3, wherein the end cap is threaded.

11. The linear explosive disruption tool of claim 1, wherein the cover cap is threaded.

12. The method of claim 5, wherein the linear explosive disruption tool targets a hazardous explosive device.

13. The method of claim 12, wherein the hazardous explosive device is a soft cased bag or an underwater mine casing.

14. A linear explosive disruption tool, comprising: an exterior housing; a cover cap; a first interior chamber fully contained within the exterior housing; a barrel, wherein the barrel provides linear support to explosive gases allowing the gases to travel rearward along a single axis and exit the linear explosive disruption tool; a second interior chamber being concentrically connected and completely internal to a cavity formed by the barrel and the cover cap; a projectile housing; a projectile; an explosive cavity lid concentrically connected to the projectile housing at one end; a third interior chamber fully contained within the projectile housing and within the second interior chamber; a blasting cap or explosive, wherein upon detonation explosively propels the projectile through the second and third interior chambers to exit the entire linear explosive disruption tool for precision targeting; at least one high strength foam metal absorber placed within the first interior chamber of the exterior housing and having the ability to collapse due to absorption of fragmentation and absorption of energy generated from the barrel during an explosion of a blasting cap or explosive in the barrel; and at least one clapper member disposed within the first interior chamber of the housing, wherein the clapper member is surrounded by the high strength foam metal absorber and mechanically transfers fragmentation, gases and energy generated from the barrel during the explosion of the blasting cap or explosive in the barrel.

15. A linear explosive disruption tool, comprising: an exterior housing; a cover cap; a first interior chamber fully contained within the exterior housing; a barrel, wherein the barrel provides linear support to explosive gases allowing the gases to travel rearward along a single axis and exit the linear explosive disruption tool; a second interior chamber being concentrically connected and completely internal to a cavity formed by the barrel and the cover cap; a projectile housing; an explosive cavity lid concentrically connected to the projectile housing at one end; a third interior chamber fully contained within the projectile housing and within the second interior chamber; a projectile fully contained within the third interior chamber; a blasting cap or explosive, wherein upon detonation explosively propels the projectile through the second and third interior chambers to exit the entire linear explosive disruption tool for precision targeting; at least one high strength foam metal absorber placed within the first interior chamber of the exterior housing and having the ability to collapse due to absorption of fragmentation and absorption of energy generated from the barrel during an explosion of a blasting cap or explosive in the barrel; and at least one clapper member disposed within the first interior chamber of the housing, wherein the clapper member is surrounded by the high strength foam metal absorber and mechanically transfers fragmentation, gases and energy generated from the barrel during the explosion of the basting cap or explosive in the barrel.

* * * * *